US012421071B2

(12) United States Patent
Liu et al.

(10) Patent No.: US 12,421,071 B2
(45) Date of Patent: Sep. 23, 2025

(54) DEVICE FOR STORING A SHEET PILE IN A CONVERTING MACHINE AND CONVERTING MACHINE

(71) Applicant: BOBST (SHANGHAI) LTD, Shanghai (CN)

(72) Inventors: Shelly Liu, Shanghai (CN); Justing Zhai, Shanghai (CN); John Wang, Shanghai (CN); Chao Sun, Shanghai (CN)

(73) Assignee: BOBST (SHANGHAI) LTD, Shanghai (CN)

( * ) Notice: Subject to any disclaimer, the term of this patent is extended or adjusted under 35 U.S.C. 154(b) by 252 days.

(21) Appl. No.: 17/760,235

(22) PCT Filed: Jan. 28, 2021

(86) PCT No.: PCT/IB2021/050662

§ 371 (c)(1),
(2) Date: Aug. 5, 2022

(87) PCT Pub. No.: WO2021/161122

PCT Pub. Date: Aug. 19, 2021

(65) Prior Publication Data

US 2023/0057628 A1 Feb. 23, 2023

(30) Foreign Application Priority Data

Feb. 13, 2020 (EP) ..... 20020069

(51) Int. Cl.
*B65H 31/00* (2006.01)

(52) U.S. Cl.
CPC ..... *B65H 31/00* (2013.01); *B65H 2301/5421* (2013.01); *B65H 2402/441* (2013.01)

(58) Field of Classification Search
CPC ..... B65H 2301/5421
See application file for complete search history.

(56) References Cited

U.S. PATENT DOCUMENTS 5,707,058 A * 1/1998 Hirth ..... B65H 31/32 271/189
5,810,351 A 9/1998 Ruckert et al.
(Continued)

FOREIGN PATENT DOCUMENTS

CN 1939827 A 4/2007
CN 203414295 U 1/2014
(Continued)

OTHER PUBLICATIONS

Translation of JP-2004026475-A (Year: 2025).*
European Patent Office, International Search Report, PCT/IB2021/050662, Apr. 23, 2021, 4 pages, Europe.

*Primary Examiner* — Howard J Sanders
(74) *Attorney, Agent, or Firm* — Bookoff McAndrews, PLLC

(57) ABSTRACT

A device for storing a sheet pile in a converting machine (10) comprises a transfer mechanism (28) for delivering sheets (22) into a piling area (26) of the device (22), and a sampling plate (44) which is adjustable between a sampling position and an access position, wherein the top of the piling area (26) is covered by the sampling plate (44) when the sampling plate (44) is in the sampling position and the top of the piling area (26) is free when the sampling plate (44) is in the access position.

7 Claims, 7 Drawing Sheets

(56) References Cited

U.S. PATENT DOCUMENTS

| | | | | |
|---|---|---|---|---|
| 7,891,650 | B2 * | 2/2011 | Forch | B65H 29/585 270/58.33 |
| 2007/0102875 | A1 | 5/2007 | Maierhofer et al. | |

FOREIGN PATENT DOCUMENTS

| | | | | |
|---|---|---|---|---|
| CN | 206940053 | U | | 1/2018 |
| CN | 109534033 | A | | 3/2019 |
| CN | 209764458 | U | | 12/2019 |
| DE | 553079 | C | | 6/1932 |
| DE | 1962536 | U | | 6/1967 |
| DE | 3412183 | A1 | * | 1/1985 |
| DE | 19612280 | A1 | | 10/1996 |
| EP | 1149791 | B1 | | 4/2004 |
| JP | 2004026475 | A | * | 1/2004 |
| TW | 201843024 | A | | 12/2018 |
| WO | 2017099992 | A1 | | 6/2017 |

* cited by examiner

DEVICE FOR STORING A SHEET PILE IN A CONVERTING MACHINE AND CONVERTING MACHINE

CROSS-REFERENCE TO RELATED APPLICATION(S)

This patent application is a National Stage Application under 35 U.S.C § 371 of International Patent Application No. PCT/IB2021/050662, filed on Jan. 28, 2021, which claims priority to European Patent Application No. 20020069.9, filed on Feb. 13, 2020, the entireties of which are incorporated herein by reference.

The invention relates to a device for storing a sheet pile in a converting machine and a converting machine.

Converting machines are used in the packaging industry for processing raw materials, e.g. cardboard, paper or foils, into intermediate or finished products, typically in the form of sheets. Converting operations can be printing, cutting, creasing, stamping and/or folding-gluing. Accordingly, the term converting machine here also generally means sheet processing machine. The sheets can be collected in vertical stacks after converting in a designated piling area of the converting machine.

In order to control the quality of the produced sheets, it is necessary to regularly collect sample sheets during operation of the converting machine. For this purpose, converting machines can have mechanisms for temporarily creating an access to the piling area such that an operator can manually pick sample sheets from the pile of produced sheets. However, to ensure a controlled and safe access for the operator, known mechanisms need redundant security systems which restrict the available space for the operator and/or necessitate the converting machine to stop the sheet production for extended periods of time.

The object of the invention is to provide a device which allows for an easier collection of sample sheets in a converting machine. Preferably, the device allows reducing the downtime of a converting machine.

The object of the invention is solved by a device for storing a sheet pile in a converting machine wherein the device comprises a transfer mechanism for delivering sheets into a piling area of the device, and a sampling plate which is adjustable between a sampling position and an access position, wherein the top of the piling area is covered by the sampling plate when the sampling plate is in the sampling position and the top of the piling area is free when the sampling plate is in the access position.

The expression "the piling area is covered" here has the meaning of the sampling plate being arranged above the piling area so that sheets delivered by the transfer mechanism cannot reach the piling area anymore but are rather collected by the sampling plate.

The sampling plate especially completely covers the top of the piling area.

The sheets are subjected to one or more converting operations by the converting machine, e.g. printing, cutting, creasing, stamping and/or folding-gluing and are fed by the converting machine by means of the transfer mechanism to the piling area.

The transfer mechanism can be the same transfer mechanism used in the overall converting machine or be connected to an additional converting machine transfer mechanism.

During operation of the converting machine, the sheets are stacked in a vertical pile in the piling area of the device as long as the sampling plate is in the access position. If the sampling plate is in the sampling position, the sheets produced by the converting machine are collected on the sampling plate instead.

Preferably, in the sampling position, the sampling plate is parallel to the sheets in the sheet pile so that further sheets produced by the converting machine can be placed on the sampling plate in the same manner as they would be stacked on the sheet pile.

The sheets can be made out of cardboard, paper, foil or a composite material.

The device according to the invention allows for collecting sample sheets in an easy manner by adjusting the position of the sampling plate. The at least one sample sheet on the sampling plate can afterwards be collected and checked for its quality.

Preferably, an operator can reach the sampling plate for collecting the sheets when the sampling plate is in the access position while the converting machine is in operating mode, i.e. processes sheets. In this way, the downtime of the converting machine is reduced.

The sampling plate can be adjusted from the access position into the sampling position manually and/or by a drive.

In one variant, the sampling plate at least partially extends outside of a housing of the device when being in the access position.

The housing of the device can be the housing of the converting machine, too.

With other words, the sampling plate preferably at least partially extends out of the converting machine to allow the operator to easily pick up the sheets collected by the sampling plate without the need for an access to inner parts of the converting machine.

In another variant, the sampling plate is removably engagable with an opening of the housing. In this way, it is possible to insert the sampling plate into the device only when needed, i.e. when sheets need to be collected.

The sampling plate can have a folding edge to flip over the part of the sampling plate which extends from the housing. This allows for a more compact storage of the sampling plate when it is not needed to collect sheets.

In another variant, the sampling plate comprises several segments which can be at least partially folded against each other. This allows for non-linear movements of the sampling plate when being adjusted between the sampling position and the access position.

The device preferably comprises a guide rail extending at least partially along a side boundary of the piling area and along which the sampling plate moves when being adjusted between the access position and the sampling position.

At least the part of the guide rail which extends along the side boundary of the piling area can be parallel to the sheets of the sheet pile.

The guide rail ensures a controlled movement of the sampling plate when the sampling plate is adjusted to the sampling position.

Preferably, the device comprises two guide rails at opposite side boundaries of the piling area. In this way, the movement of the sampling plate is further secured and shifting and tilting of the sampling plate is prevented.

The one or more guide rails especially extend from the housing of the device over the full length of the respective side boundary of the piling area.

Preferably, the device comprises a jogger which is arranged between the sampling plate and a front boundary of the piling area when the sampling plate is in the access position.

The jogger is used to align the sheets in the sheet pile when and/or after they are and/or have been delivered by the transfer mechanism. For this purpose, the jogger can be tilted back and forth towards and away from the front boundary of the piling area so that the sheets in the piling area are aligned to each other.

The front boundary of the piling area especially is perpendicular to the side boundary of the piling area.

The jogger especially extends over the full length of the front boundary of the piling area.

Further, the device can comprise at least one lateral jogger arranged at the side boundary of the piling area.

The lateral jogger is also used to align the sheets in the sheet pile when and/or after they are and/or have been delivered by the transfer mechanism. For this purpose, the lateral jogger can be tilted back and forth towards and away from the side boundary of the piling area.

The device can comprise several lateral joggers, especially at least one lateral jogger at both side boundaries of the piling area.

The lateral jogger can extends over the full length of the side boundary of the piling area.

In one embodiment, the jogger and/or the at least one lateral jogger can be adjusted between a working position and a clearing position by a drive element, wherein the sampling plate can be adjusted into the sampling position only when the jogger and/or the at least one lateral jogger is/are in the clearing position.

In this embodiment, the jogger and/or the lateral jogger do not need to be mounted such that they are at all times below or above the level on which the sampling plate is moved over the piling area. This allows for reducing the necessary size of the device.

At the same time, the jogger and/or the lateral jogger prevents the sampling plate from accidentally blocking the piling area.

The drive element can comprise a piston which can be driven electrically, pneumatically and/or hydraulically.

The device can comprise a sensor adapted for monitoring the position of the sampling plate.

The sensor is especially located between the housing of the device and the piling area, preferably between the housing of the device and the jogger.

The sensor allows to determine if the sampling plate is moved out of the access position. In this case, the jogger and/or the one or more lateral joggers can be automatically adjusted into the clearing position.

The sensor can be a light barrier.

The object of the invention is further solved by a converting machine comprising a device as described before.

Further advantages and features will become apparent from the following description of the invention and from the appended figures which show a non-limiting exemplary embodiment of the invention and in which.

Figure 1:
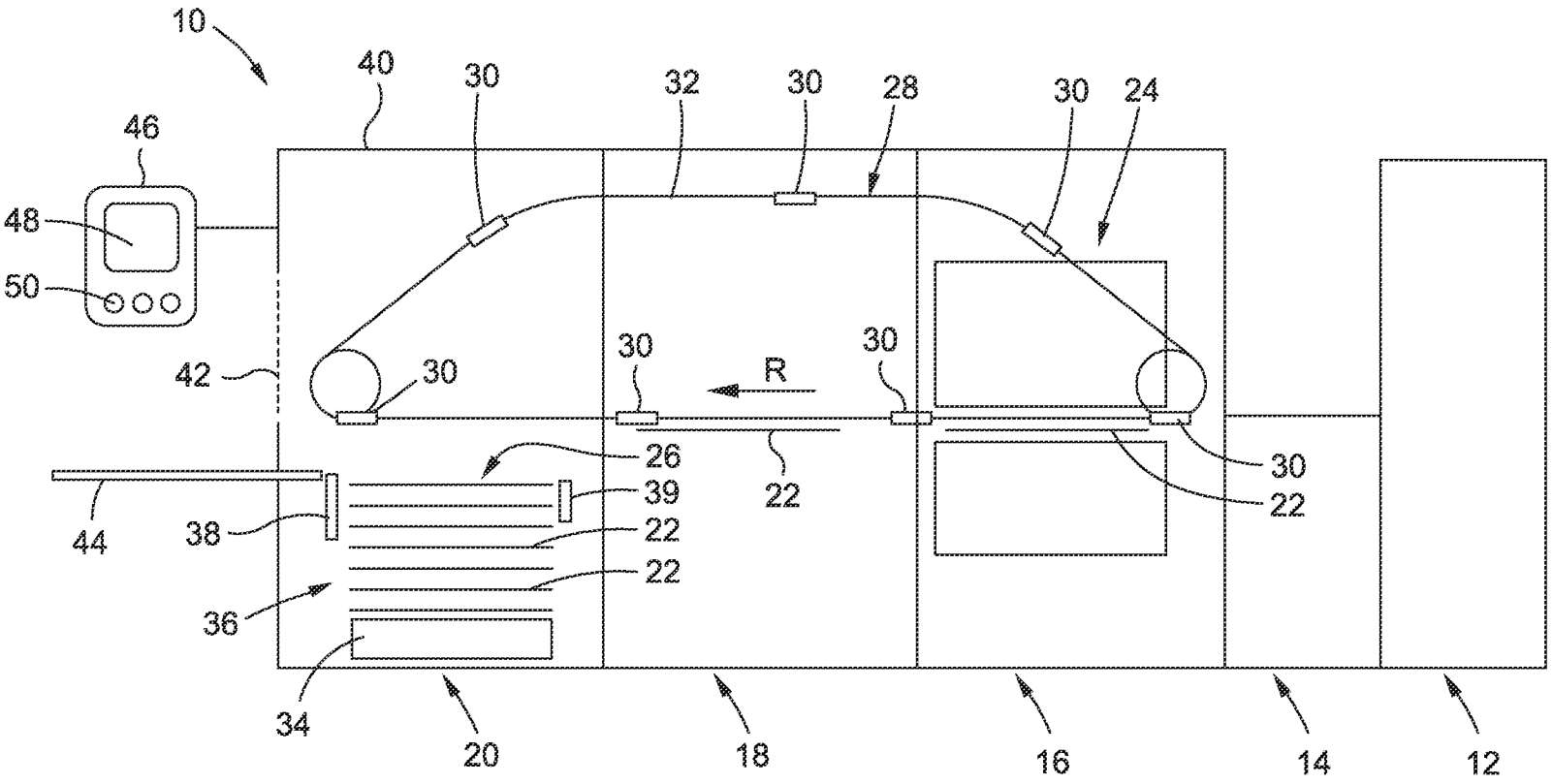
FIG. 1 shows a schematic converting machine comprising a device according to the invention.

FIG. 1 shows a converting machine 10 according to the invention. The converting machine 10 is composed of several modules which are arranged one after another. In the shown embodiment, the converting machine 10 comprises a loading station 12, a feeder 14, a converting station 16, a discharge station 18, and a device 20 according to the invention.

The converting machine 10 has a running direction R which is defined by the direction in which sheets are being processed.

The loading station 12 is used for supplying the converting machine 10 with raw sheets to be processed. The raw sheets can be made out of cardbox, paper or plastic.

The individual raw sheets are taken out of the loading station 12 by the feeder 14 and fed into the converting station 16.

The converting station 16 can be a cutting station, an embossing station or a stamping station. In the shown embodiment, the converting machine comprises a platen press 24. In the converting station 16, the raw sheets are converted to sheets 22.

The discharge station 18 is used to transfer the sheets 22 from the converting station 16 to a piling area 26 of the device 20. The discharge station 18 can also be used to ensure correct alignment of the sheets 22.

The sheets 22 are moved along the running direction R by a transfer mechanism 28. The transfer mechanism 28 is adapted to individually transfer each single sheet 22 from the feeder 14 to the device 20.

The transfer mechanism 28 comprises several gripper bars 30 which take turns to grip a sheet 22 at its front edge and to pull the sheet 22 through the stations of the converting machine 10.

The gripper bars 30 are connected to a chain 32 which is moving in a closed circle. The chain 32 moves in a step-wise manner, whereby with each step the sheet 22 is moved to the next station of the converting machine 10.

In the device 20, the sheets 22 are released from the transfer mechanism 28 to form a pile of sheets in the piling area 26, e.g. on a pallet 34.

Accordingly, in the shown embodiment, only a single transfer mechanism 28 is used for all modules of the converting machine 10, including the device 20. Generally, the device 20 could comprise its own transfer mechanism 28 which is connected to a further converting machine transfer mechanism.

At a front boundary 36 of the piling area 26, a jogger 38 is arranged. The jogger 38 is used to align the processed sheets 22 along the running direction R in the piling area 26. This is done by providing a flat surface by the jogger 38 against which the sheets 22 can be pushed when delivered into the piling area 26 by the transfer mechanism 28.

Further, the device 20 comprises a back jogger 39 which is arranged at a back side of the piling area 26 opposite to the front side of the piling area 26. Accordingly, the back jogger 39 is arranged opposite to the jogger 38.

Further, the jogger 38 can tilt back and forth to align the sheets 22 in the piling area 26.

The device 20 comprises a housing 40 which in the shown embodiment is also part of the housing of the converting machine 10.

The housing 40 comprises a window 42 so that an operator of the converting machine 10 can look into the converting machine 10, especially on the sheets 22 in the piling area 26.

The housing 40 further has an opening 43 through which a sampling plate 44 partially extends outwards from the housing 40. The sampling plate 44 further comprises handles 45 which can be used by the operator to adjust the position of the sampling plate 44.

Additionally, the device 20 has a display unit 46 with a display 48 and control elements 50. The display 48 can also be a touch-sensitive display. In this case, the control elements 50 can be incorporated into the display 48. The display unit 46 can be used by an operator to control the device 20, preferably to control all modules of the converting machine 10.

Figure 2:
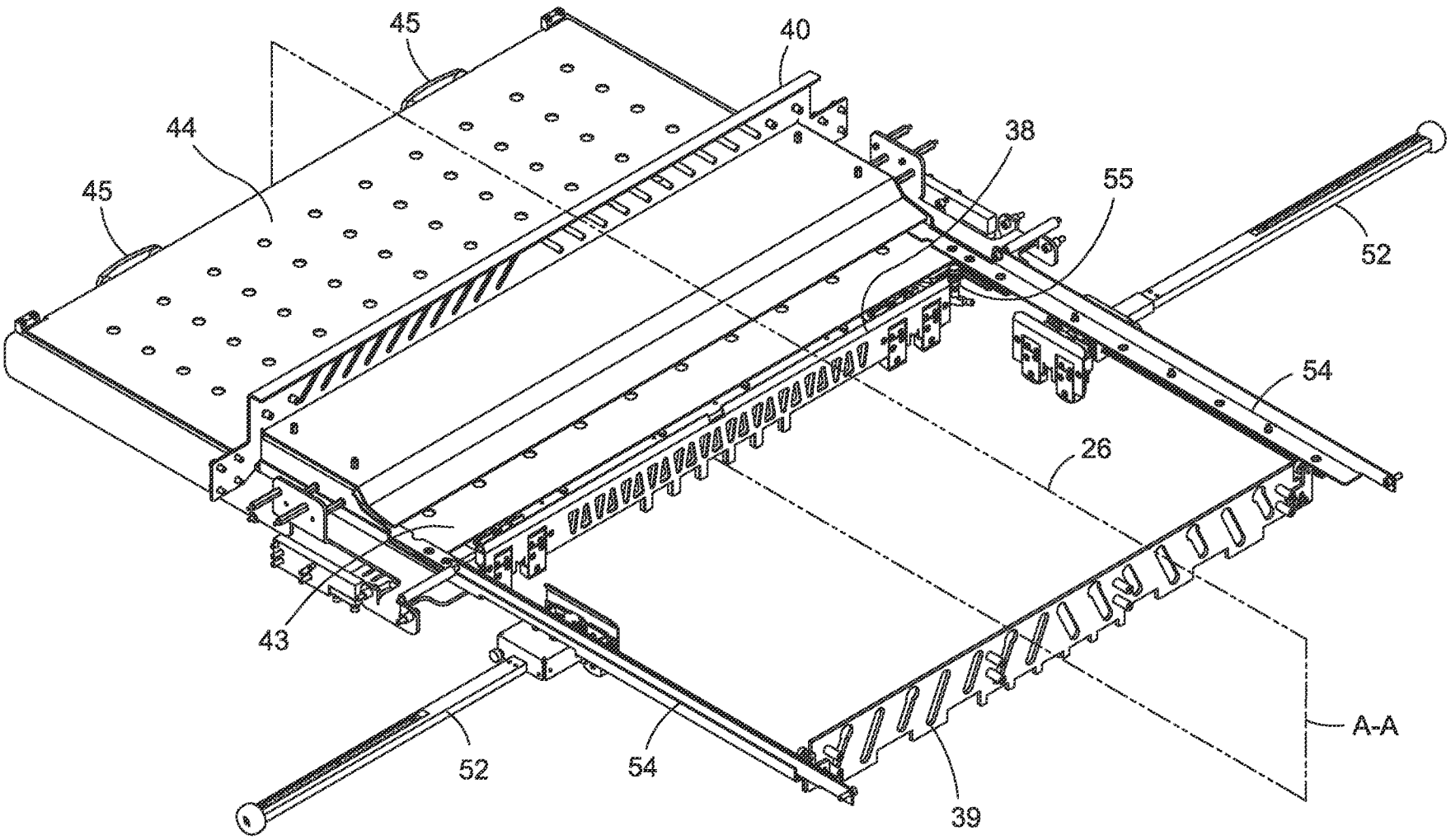
FIG. 2 shows a perspective view of parts of the device of FIG. 1 with a sampling plate in an access position.

FIG. 2 shows a perspective view of parts of the device 20.

The jogger 38 and the back jogger 39 extend essentially over the full length of the front and back surface of the piling area 26, respectively.

As can be seen from FIG. 2, additionally to the jogger 38 and the back jogger 39, the device 20 further comprises two lateral joggers 52. The lateral joggers 52 are arranged at side surfaces of the piling area 26, wherein each of the two lateral joggers 52 are arranged opposing each other at opposite side surfaces of the piling area 26.

The device 20 further comprises two guide rails 54, each one extending along one of the side boundaries of the piling area 26. The guide rails 54 further partially extend outwards of the housing 40.

The sampling plate 44 is arranged on the guide rails 54.

In FIGS. 1 and 2, the sampling plate 44 is in an access position. In the access position, the top of the piling area 26 is free so that sheets 22 can be transferred by the transfer mechanism 28 to the piling area 26 to form a sheet pile.

Additionally, the jogger 38 is arranged at a height such that the sampling plate 44 cannot slide along the guide rails 54 over the piling area 26, i.e. the jogger 38 blocks the movement of the sampling plate 44. This position of the jogger 38 is termed working position.

The device 20 further comprises a sensor 55 which can detect the position of the sampling plate 44. The sensor 55 can be a light barrier.

Figure 3:
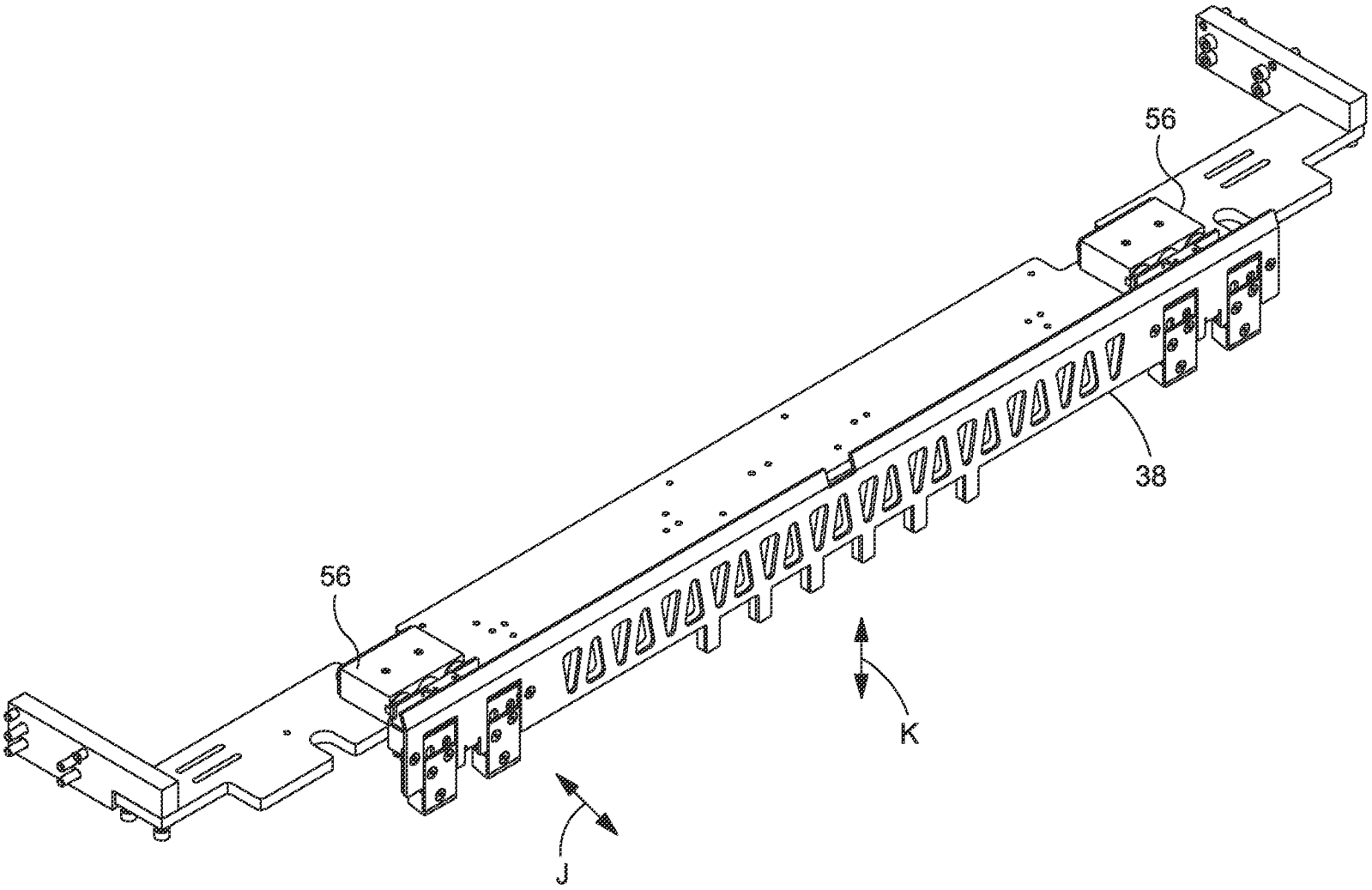
FIG. 3 shows a perspective view of the jogger of the device of FIG. 1.

FIG. 3 shows a perspective view of the jogger 38 in more detail. As illustrated in FIG. 3 by double-arrow J, the jogger 38 can be moved back and forth towards and from the piling area 26.

Additionally, the jogger 38 can be moved up and down as illustrated by double-arrow K in FIG. 3 to switch from the working position into a sampling position in which the jogger 38 no longer blocks the movement of the sampling plate 44 along the guide rails 54.

The jogger 38 can be moved along directions J and K by drive elements 56 which are cylinders with electrically driven pistons. The jogger 38 can also have separate drive elements 56 for the respective motions along directions J and K.

Figure 4:
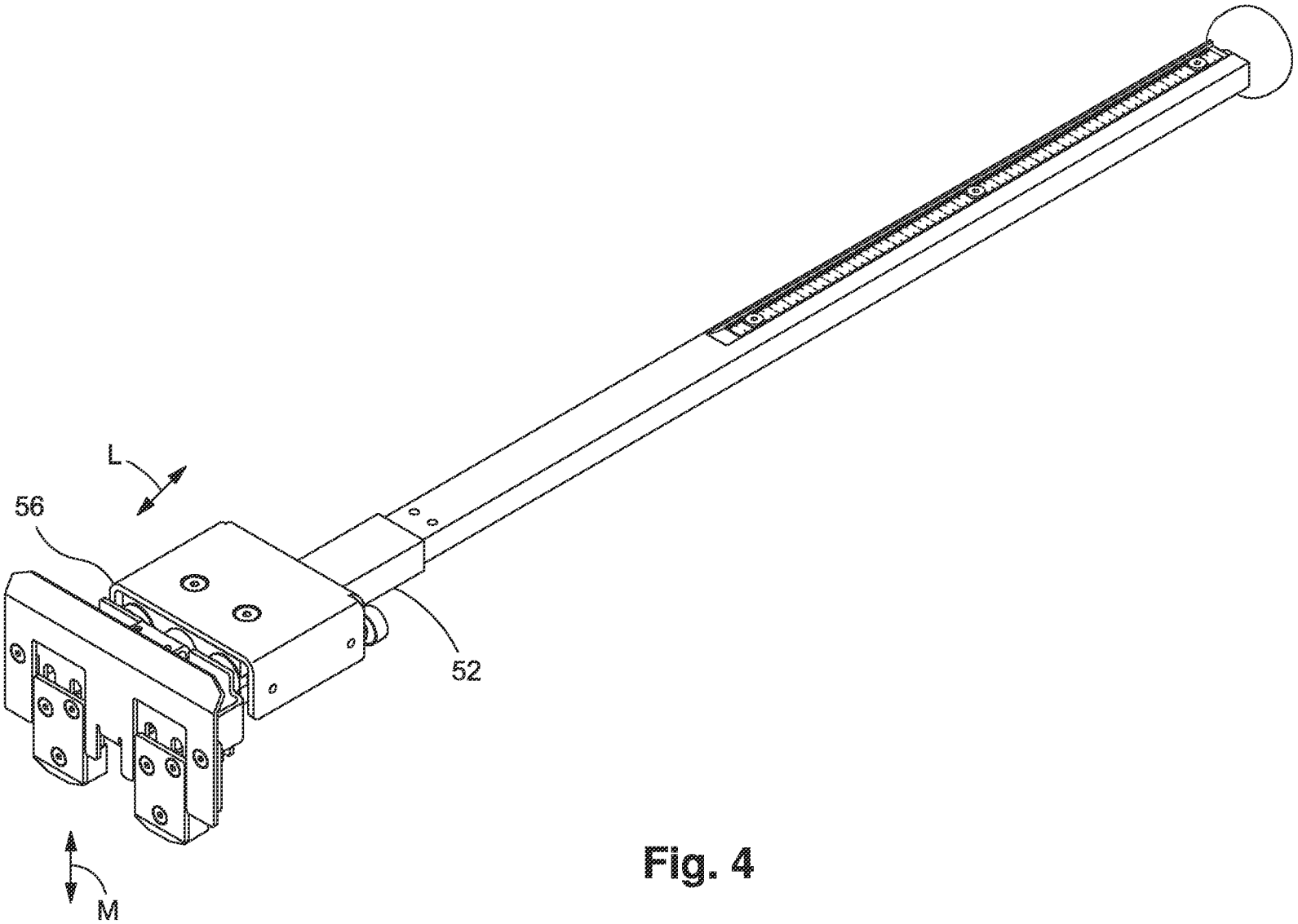
FIG. 4 shows a perspective view of a lateral jogger of the device of FIG. 1.

FIG. 4 shows one of the lateral joggers 52 in more detail. The lateral jogger 52 can be moved sideways along the directions illustrated by double-arrow L and up and down along the directions illustrated by double-arrow M.

Figure 5:
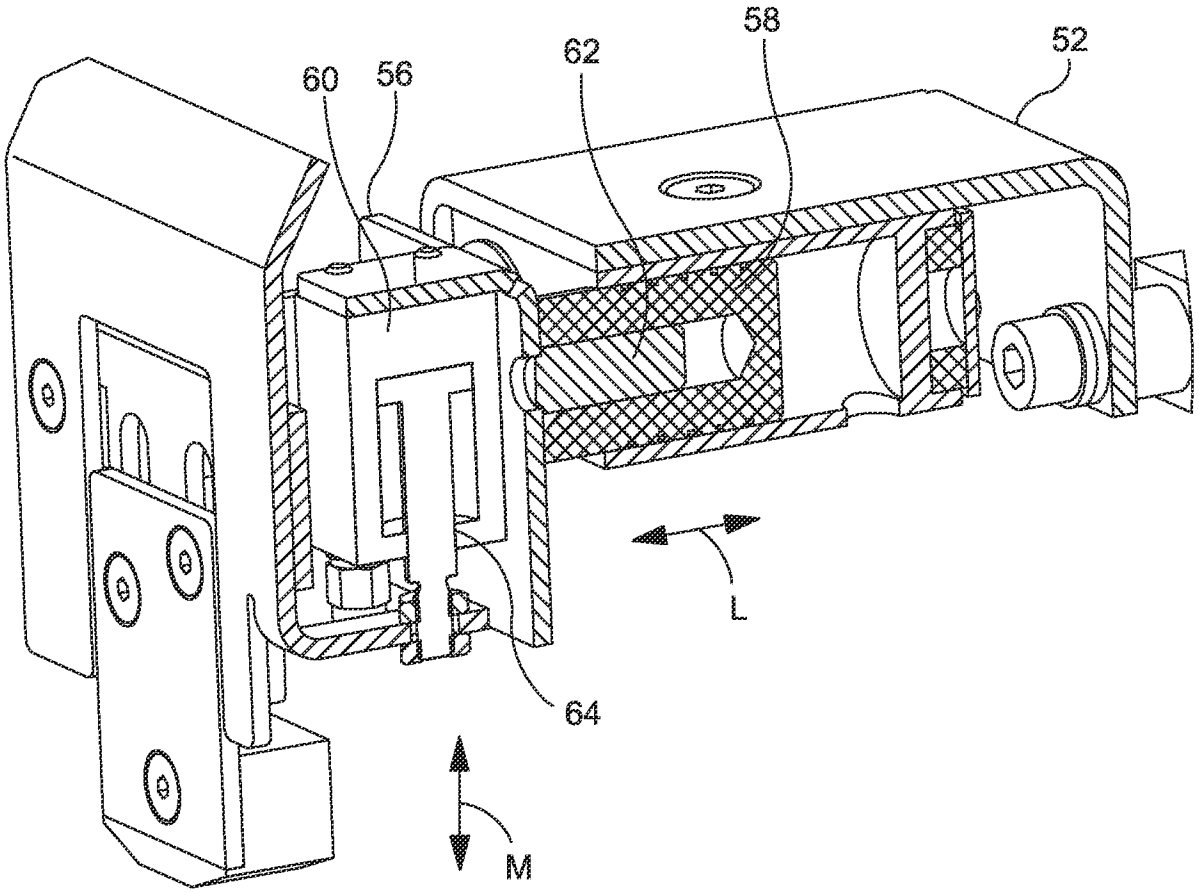
FIG. 5 shows a cross-section of a detail of the lateral jogger of FIG. 4.

FIG. 5 shows a cross-section along the center of the extension direction of the lateral jogger 52 of FIG. 4.

The drive element 56 of the lateral jogger 52 comprises two cylinders 58 and 60, one with a piston 62 moving along the direction L and a second one with a piston 64 moving along the direction M. The pistons 62, 64 can both be driven electrically, pneumatically or hydraulically. The pistons 62, 64 can also use different drive mechanisms.

The lateral joggers 52 also can be adjusted into a working position in which the movement of the sampling plate 44 along the guide rails 54 is blocked by the lateral joggers 52 and into a sampling position in which the lateral jogger 52 no longer blocks the movement of the sampling plate 38 along the guide rails 54.

Figure 6:
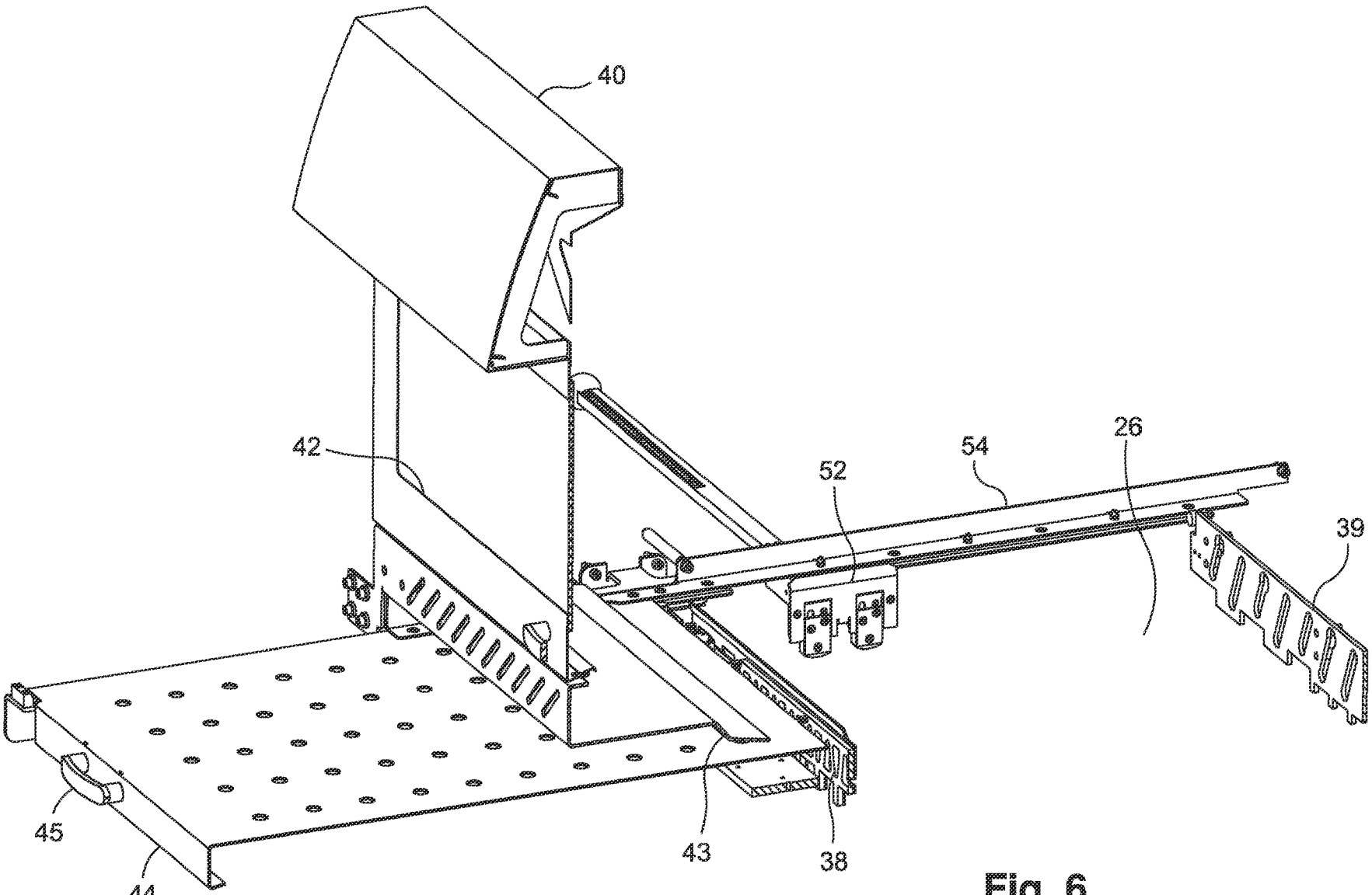
FIG. 6 shows a perspective view of a cross-section of the device of FIG. 2 along plane A-A with the sampling plate in the access position.

In the following, the mode of operation of the device 20 will be described with reference to FIGS. 6 and 7 which show perspective views of a cross-section along plane A-A shown in FIG. 2.

During default operation of the converting machine 10, sheets 22 will be processed and delivered by the transfer mechanism 28 to the piling area 26.

The jogger 38, the back jogger 39 and the lateral joggers 52 are used to align the sheets 22 delivered to the piling area 26.

The sampling plate 44 is in the access position in which it partially extends from the housing 40 outwards. Accordingly, the sampling plate 44 is outside of the path of the sheets 22 towards the piling area 26.

The operator of the converting machine 10 can observe the sheets 22 arriving at the piling area 26 through the window 42. If the operator decides to take sample sheets, e.g. for checking the quality of the processed sheets 22, he can start a sampling procedure by pressing a sampling button which is one of the control elements 50 of the display unit 46.

This stops the transfer mechanism 28 from delivering new sheets 22 to the piling area 26 for a pre-selected time period $t_1$, e.g. for 1 to 3 seconds.

Further, the jogger 38 and the lateral joggers 52 are moved downwards into their sampling positions by their respective drive elements 56 so that the guide rails 54 are no longer blocked.

Then, the display unit 46 gives the operator a signal that the sampling plate 44 can be moved into the sampling position. The signal can be given visually on the display 48 or acoustically by means of a (not shown) loudspeaker.

Figure 7:
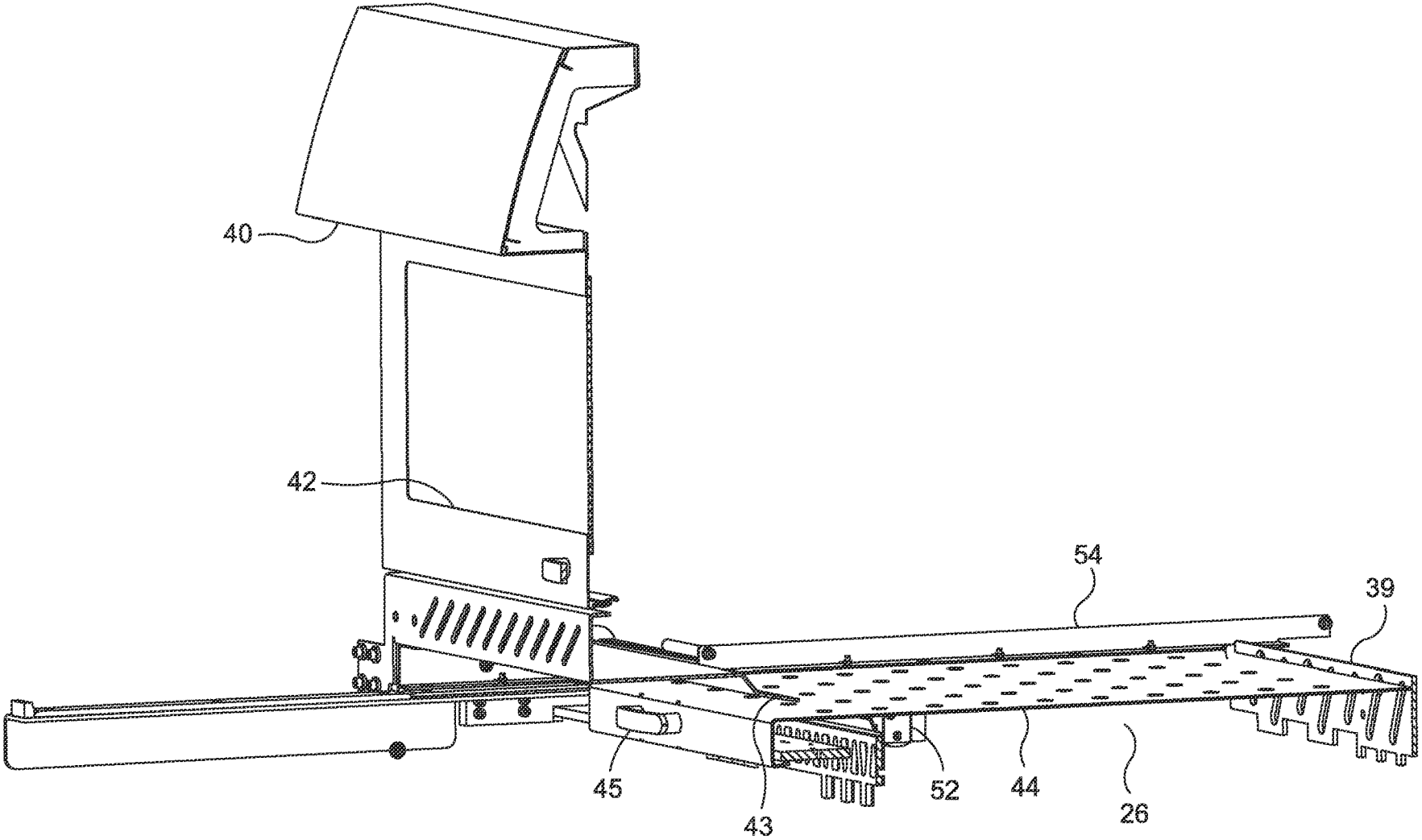
FIG. 7 shows a perspective view of a cross-section of the device of FIG. 2 along plane A-A with the sampling plate in a sampling position.

The sampling plate 44 can then be pushed through the opening 43 by the operator by means of handles 45 until the sampling plate 44 covers the piling area 26 (shown in FIG. 7). The sampling plate 44 could also be moved by a (not shown) drive.

Alternatively, the jogger 38 and the lateral joggers 52 could also automatically change to their respective sampling positions as soon as the sensor 55 detects that the sampling plate 44 is moved out of its access position.

After the time period $t_1$, the transfer mechanism 28 delivers a pre-defined number of sheets 22 into the device 20. As the piling area 26 is now covered by the sampling plate 44, these sheets 22 are collected on the sampling plate 44.

The number of sheets 22 can be a set number based on the desired amount of sample sheets and/or the total height of the collected sample sheets on the sampling plate. The pre-defined number of sheets 22 can also be manually entered or adjusted by the operator with the display unit 46.

The number of sheets 22 must be small enough to allow movement of the sampling plate 44 and the collected sample sheets through the opening 43.

After the pre-defined number of sample sheets have been collected, the transfer mechanism 28 again stops delivering sheets 22 for a pre-determined time period $t_2$.

The time periods $t_1$ and $t_2$ can have the same length or different lengths and can be adjusted and/or chosen by the operator independently of each other.

During the time period $t_2$, the operator can move the sampling plate 44 back to the access position, thereby removing the collected sample sheets from the housing 40.

After the time period $t_2$, the jogger 38 and the lateral joggers 52 are moved back to their working positions and the transfer mechanism 28 again starts to deliver processed sheets 22 to the piling area 26.

The operator can easily pick up the sample sheets from the sampling plate 44 outside of the housing 40 while the converting machine again starts to run.

Accordingly, the device 20 allows reducing downtime of the converting machine 10 and provides an easier way for collecting sample sheets.

The invention claimed is:

1. A device for storing a sheet in a converting machine, the device comprising:

a transfer mechanism for delivering the sheet into a piling area of the device, wherein the transfer mechanism delivers the sheet in a first direction, a housing including a guide rail, and a sampling plate which is adjustable between a sampling position and an access position by moving along the guide rail, wherein the sampling plate moves from the access position to the sampling position in a second direction, opposite to the first direction, to receive the sheet from the transfer mechanism, and moves in the first direction from the sampling position to the access position with the sheet and thereby moving the sheet away from the piling area, wherein a top of the piling area is covered by the sampling plate when the sampling plate is in the sampling position so that the transfer mechanism delivers the sheet to the sampling plate, and the top of the piling area is accessible when the sampling plate is in the access position so that the transfer mechanism delivers the sheet to the piling area, wherein in the access position, the sampling plate extends at least partially outwards from an opening within the housing, and wherein in the sampling position, the sampling plate is moved at least partially through the opening into the housing, and wherein in the sampling position, the sampling plate contacts a back jogger forming a back side of the piling area.

2. The device according to claim 1, wherein the sampling plate completely covers the top of the piling area.

3. The device according to claim 1, wherein the guide rail has a longitudinal axis, the longitudinal axis extending in the first direction at least partially along a side boundary of the piling area.

4. The device according to claim 1, further comprising:

a jogger arranged between the sampling plate and a front boundary of the piling area when the sampling plate is in the access position.

5. The device according to claim 4, further comprising:

a lateral jogger arranged at a side boundary of the piling area.

6. The device according to claim 5, wherein one or more of the jogger or the lateral jogger is adjustable between a working position and a clearing position by a drive element, wherein the sampling plate is adjustable into the sampling position only when the one or more of the jogger or the lateral jogger is in the clearing position.

7. The device according to claim 1, further comprising:

a sensor adapted for monitoring a position of the sampling plate.

* * * * *